US005474692A

United States Patent [19]

Laufenberg et al.

[11] Patent Number: 5,474,692

[45] Date of Patent: Dec. 12, 1995

[54] LUBRICANT CONCENTRATE AND AN AQUEOUS LUBRICANT SOLUTION BASED ON FATTY AMINES, A PROCESS FOR ITS PRODUCTION AND ITS USE

[75] Inventors: Alfred Laufenberg, Leobendorf, Austria; Wolfgang Preibsch, Merzenich; Karl-Heinz Schmitz, Erkrath, both of Germany

[73] Assignee: Henkel Kommanditgesellschaft auf Aktien, Duesseldorf, Germany

[21] Appl. No.: 379,628

[22] PCT Filed: Jul. 26, 1993

[86] PCT No.: PCT/EP93/01984

§ 371 Date: Feb. 3, 1995

§ 102(e) Date: Feb. 3, 1995

[87] PCT Pub. No.: WO94/03562

PCT Pub. Date: Feb. 17, 1994

[30] Foreign Application Priority Data

Aug. 3, 1992 [DE] Germany ..... 42 25 254.7

[51] Int. Cl.[6] ..... C10M 133/04; C10M 173/02

[52] U.S. Cl. ..... 252/34; 252/49.3

[58] Field of Search ..... 252/49.3, 34

[56] References Cited

U.S. PATENT DOCUMENTS

| | | | |
|---|---|---|---|
| 2,976,179 | 3/1961 | Westlund et al. | 252/34 |
| 2,990,943 | 7/1961 | Turinsky | 252/34 |
| 3,634,243 | 1/1972 | Wessels et al. | 252/49.3 |
| 3,962,104 | 6/1976 | Swietlik et al. | 252/34 |
| 4,374,034 | 2/1983 | Coleman | 252/51.5 A |
| 4,505,831 | 3/1985 | Fenyes et al. | 252/49.3 |
| 4,537,694 | 8/1985 | Horodysky | 252/51.5 A |
| 4,647,389 | 3/1987 | Karol et al. | 252/34 |
| 5,174,914 | 12/1992 | Gutzmann | 252/34 |
| 5,356,548 | 10/1994 | Pera et al. | 252/49.3 |

FOREIGN PATENT DOCUMENTS

| | | |
|---|---|---|
| 0044458 | 1/1982 | European Pat. Off. . |
| 0372628 | 6/1990 | European Pat. Off. . |
| 2313330 | 10/1973 | Germany . |
| 3631953 | 3/1988 | Germany . |
| 3831448 | 3/1990 | Germany . |
| 3905548 | 9/1990 | Germany . |
| 9010053 | 9/1990 | WIPO . |
| 9213049 | 8/1992 | WIPO . |

*Primary Examiner*—Ellen M. McAvoy
*Attorney, Agent, or Firm*—Ernest G. Szoke; Wayne C. Jaeschke; Henry E. Millson, Jr.

[57] ABSTRACT

Lubricant concentrates and aqueous lubricant solutions containing at least one polyamine derivative of a fatty amine and/or a salt of such an amine. The invention also relates to a process for the production of the lubricant concentrates and to the use of the lubricant concentrates and the aqueous lubricant solutions as chain lubricants in the food industry.

19 Claims, No Drawings

LUBRICANT CONCENTRATE AND AN AQUEOUS LUBRICANT SOLUTION BASED ON FATTY AMINES, A PROCESS FOR ITS PRODUCTION AND ITS USE

BACKGROUND OF THE INVENTION

1. Field of the Invention

This invention relates to a lubricant concentrate and to an aqueous lubricant solution based on fatty amines and optionally typical diluents and/or auxiliaries and additives which contain at least one polyamine derivative of a fatty amine and/or a salt of such an amine.

The invention also relates to a process for the production of the lubricant concentrate and to the use of the lubricant concentrate and the aqueous lubricant solution as chain lubricants in the food industry. More particularly, the lubricant concentrate according to the invention is used for lubricating, cleaning and disinfecting automatic chain and belt conveyor systems which are used for the filling of foods, preferably beverages, into glass and plastic bottles, cans, glasses, casks, beverage containers (KEGS), paper and cardboard containers and the like.

2. Statement of Related Art

In bottle cellars and barrel cellars of beverage factories and in the packaging of foods, the corresponding containers are normally transported on plate-type conveyor belts or other conveyor systems which are lubricated and kept clean with suitable aqueous lubricant preparations via immersion-type lubrication systems or, recently, even via automatic belt lubrication systems.

Whereas immersion-type lubrication systems present hardly any problems in regard to their performance properties and the choice of the lubricant, precipitations of poorly soluble salts and microbiological deposits in the nozzles and filters of the central lubrication systems can seriously disrupt the continuous packaging of foods, particularly beverages, so that the systems always have to be switched off and cleaned after a certain period of operation.

The chain lubricants hitherto used as lubricants are based on the one hand on fatty acids in the form of their water-soluble alkali metal or alkanolamine salts or on fatty amines in the form of their organic or inorganic salts.

Whereas both classes of compounds can be used without difficulty in immersion lubrication, they show a number of disadvantages in the central chain lubrication systems typically used today. Thus, DE-A-23 13 330 describes soap-based lubricants containing aqueous mixtures of $C_{16-18}$ fatty acid salts and surfactants. These soap-based lubricants have the following disadvantages:

1. They react with the hardness of the water, i.e. with alkaline earth metal ions, and other ingredients of the water to form poorly soluble metal soaps, so-called primary alkaline earth metal soaps.
2. The soap-based lubricants react with carbon dioxide dissolved in water or in the product to be packed.
3. The in-use solution thus produced is always germ-promoting.
4. Where hard water is used, ion exchangers have to be used for softening, which represents an additional germ source, or products of high complexing agent content have to be used which is ecologically unsafe.
5. Increased foaming occurs which, in particular, gives rise to problems for the bottle inspector (automatic bottle control) and to possible penetration of the lubricant into the transport container.
6. Most of these products contain solvents.
7. The cleaning effect of the products is poor so that separate discontinuous cleaning is always necessary.
8. The soap-based lubricant preparations in question show pH-dependent performance behavior.
9. In addition, soap-based lubricant preparations are dependent on water temperature.
10. Soap-based lubricants show poor stability in storage, particularly at low temperatures.
11. The EDTA (ethylenediamine tetraacetate) present in many products shows poor biodegradability.
12. The soap-based lubricant preparations in question are not suitable for all types of plastic containers because stress cracking often occurs in the containers where these preparations are used.

Apart from these so-based lubricants, lubricants based on fatty amines are otherwise mainly used. Thus, DE-A-36 31 953 describes a process for the lubrication of chain-like bottle conveyors in bottling plants, particularly in breweries, and for cleaning the belts with a liquid cleaning preparation which is characterized in that the chain-like bottle conveyors are lubricated with belt lubricants based on neutralized primary fatty amines which preferably contain 12 to 18 carbon atoms and which have an unsaturated component of more than 10%.

EP-A-0 372 628 describes fatty amine derivatives corresponding to the following formulae:

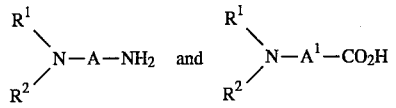

in which $R^1$ is a saturated or unsaturated, linear or branched $C_{8-22}$ alkyl group, $R^2$ is hydrogen, a $C_{1-4}$ alkyl or hydroxyalkyl group or $—A—NH_2$, A is a linear or branched $C_{1-6}$ alkylene group and $A^1$ is a linear or branched $C_{2-4}$ alkylene group, as lubricants.

In addition, lubricants based on N-alkylated fatty amine derivatives containing at least one secondary and/or tertiary amine are known from DE-A-39 05 548.

The main disadvantage of these lubricants is that they react with anions in the water, more particularly with sulfates, bicarbonates, phosphates and carbonates from alkaline waters, and other water ingredients.

In addition, these lubricants based on fatty amines show unsatisfactory foaming behavior. Thus, the lubricants according to EP-A-0 372 628 tend to foam vigorously so that the material transported on the belt has to be subsequently cleaned. By contrast, the lubricants according to DE-A-39 05 548 show inadequate foaming so that the lubricant film applied soon drains off.

Accordingly, the main disadvantages of the lubricants mentioned above are the pronounced dependence on water of soap-based lubricants and, on the other hand, the compulsory cleaning of the system at regular intervals where lubricants based on fatty amines are used which is again attributable to the water ingredients. The precipitations occurring in both known processes have to be removed at the same time. A simple acid/base reaction is used for this purpose. In the case of soap products based on fatty acids, alkaline cleaners containing complexing agents are used to this end, cleaners in the form of organic or inorganic acids being used as technical equivalents in the case of products based on fatty amines.

Finally, there are some known chain lubricants which only have some of the disadvantages described above. Thus, EP-A-0 044 458 relates to lubricant preparations which are substantially free from fatty acid soaps and which, in addition, contain a carboxylated nonionic surfactant and an acyl sarcosinate. The pH value of these products is in the range from 7 to 11 and is thus preferably in the neutral to alkaline range.

Finally, DE-A-38 31 448 relates to aqueous soap-free lubricant preparations which form clear solutions in water, to a process for their production and to their use in particular as lubricants for plate-type conveyor belts used for transporting glass bottles or polyethylene terephthalate bottles. The substantially neutral aqueous lubricant preparations (pH 6 to 8) contain alkylbenzene sulfonates, alkyloxyated alkanol phosphates and alkane carboxylic acids, optionally in addition to typical solubilizers, solvents, defoaming agents and disinfectants.

DESCRIPTION OF THE INVENTION

However, these two amine-free products also show the following disadvantages:

1. They are unfavorable in microbiological terms because they establish excellent growth conditions for microorganisms.
2. In addition, their cleaning performance is poor.
3. Finally, their foaming behavior is also difficult to control.

Accordingly, the problem addressed by the present invention was to provide a new lubricant preparation, more particularly a chain lubricant, which would not have any of the disadvantages of the prior art. In other words, the lubricants according to the invention would have a good friction coefficient, i.e. an excellent lubricating effect, measured foaming behavior, good clear water solubility, good cleaning performance and good microbicidal activity.

In the context of the invention, the term "clear water solubility" is coupled with the stability of the lubricant ingredients to anions present in natural waters, such as sulfate, bicarbonate and the like. If, for example, the clear water solubility of a lubricant formulation is not clearly pronounced, the formulation in question can react with the water ingredients during prolonged stoppages of the plant, for example at weekends. The resulting precipitations and turbidity in the in-use solutions of the lubricants result in blockage of the filters and nozzles of the belt lubrication system in the short to medium term.

It has surprisingly been found that lubricants containing at least one polyamine derivative of a fatty amine and/or a salt of such an amine show distinctly better clear water solubility and applicationally more favorable foaming behavior than lubricants based on unsubstituted and substituted fatty amines.

Accordingly, the present invention relates to a lubricant concentrate based on fatty amines and, optionally, typical diluents or auxiliaries and additives, characterized in that it contains at least one polyamine derivative of a fatty amine and/or a salt of such an amine, the percentage content of the polyamine derivatives of fatty amines mentioned above in the formulation as a whole being from 1 to 100% by weight.

The lubricant concentrates according to the invention show excellent clear water solubility in the form in which they are diluted with water to their in-use concentration, for example in the form of aqueous solutions containing 0.02% by weight of the amines. So far as their performance properties are concerned, the aqueous lubricant solutions in question have a good friction coefficient, balanced foaming behavior, good cleaning performance and favorable microbicidal properties.

In one preferred embodiment of the present invention, the lubricant concentrate contains at least one polyamine derivative of a fatty amine corresponding to general formula (I):

$$R—A—(CH_2)_k—NH—((CH_2)_l—NH)_y—(CH_2)_m—NH_2\cdot(H^+X^-)_n \quad (I)$$

in which

R is a substituted or unsubstituted, linear or branched, saturated or mono- or polyunsaturated $C_{6-22}$ alkyl radical, the substituents being selected from amino, imino, hydroxy, halogen and carboxy, or a substituted or unsubstituted phenyl radical, the substituents being selected from amino, imino, hydroxy, halogen, carboxy and a linear or branched, saturated or mono- or polyunsaturated $C_{6-22}$ alkyl radical, A is either —NH—or —O—, $X^-$ is an anion of an inorganic or organic acid, k, l and m independently of one another are integers of 1 to 6, y is 0, 1, 2 or 3 where A=—NH— and 1, 2, 3 or 4 where A=—O— and n is an integer of 0 to 6.

In general formula (I) above, R may be any of the following substituents: n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl, n-octadecyl, n-nonadecyl, n-eicosyl, n-uneicosyl and n-docosyl and the branched-chain isomers of the alkyl radicals mentioned. Instead of the saturated alkyl radicals, R may also represent the corresponding mono- or poly-unsaturated alkyl radicals which may also be linear or branched. The radicals mentioned above may also be substituted, the substituents being one or more amine, imine, hydroxy, halogen or carboxy groups. In addition, R may also represent phenyl groups which may likewise be substituted by one or more amine, imine, hydroxy, halogen or carboxy groups. R may also represent alkyl phenyl radicals, the alkyl radical containing 6 to 22 carbon atoms and likewise being linear or branched, saturated or mono- or polyunsaturated. In every case, preferred halogen substituents are chlorine or bromine.

As already mentioned, the anion $X^-$ may be an anion of any inorganic or organic acid. The only requirement governing the choice of this acid for the purposes of the invention is that the acid or its anion should not lead to precipitations in conjunction with the polyamines of general formula (I) according to the invention which would adversely affect the clear water solubility of the lubricants according to the invention. In individual cases, the expert will make a suitable choice on the basis of simple tests.

According to the present invention, however, preferred acids are those of which the anion $X^-$ is selected from the group consisting of amidosulfonate, nitrate, halide, hydrogen sulfate, sulfate, hydrogen carbonate, carbonate, phosphate or $R^1—COO^-$, the substituent $R^1$ being hydrogen, a substituted or unsubstituted, linear or branched $C_{1-20}$ alkyl radical or $C_{2-20}$ alkenyl radical, the substituents being selected from one or more of the radicals hydroxy, amino, imino and carboxy. Accordingly, suitable anions $X^-$ in addition to the inorganic anions already mentioned are anions of organic acids corresponding to the formula $R^1$—$COO^-$ where the substituent $R^1$—$COO^-$ may be hydrogen or an alkyl or alkenyl radical; for the rest, the above definitions of R apply correspondingly. Examples of organic anions $X^-$ of the $R^1$—$COO^-$ type are, in particular, formate, acetate, glycolate, oleate, lactate, gluconate, citrate and glutamate.

Particularly preferred lubricant concentrates according to the present invention contain a polyamine derivative of a fatty amine corresponding to general formula (I) where A=—NH—, k, l and m independently of one another have values of 3 or 4, y has the value 0 or 1 and the other variables are as defined above. Amines in which k, l and m have a value of 3 are particularly preferred.

Polyamines corresponding to general formula (I) above may be prepared by methods known from the literature and, in some cases, are also commercially available, for example from Berol Nobel, Stockholm, Sweden, under the names Amin 640, Amin 660, Amin 740, Amin 760 and Amin 780.

In one preferred embodiment of the present invention, the lubricant concentrates contain polyamine derivatives of fatty amines corresponding to general formula (I) above in which R is a linear or branched, saturated or mono- or polyunsaturated $C_{12-18}$ alkyl radical, A is —NH— and $X^-$ is a group of the $R^1$—$COO^-$ type where $R^1$ is hydrogen, $CH_3$—, HO—$CH_2$— or $CH_3$—CH(OH)—.

Other preferred lubricant concentrates according to the invention are those which contain 1 to 40% by weight and, more particularly, 5 to 15% by weight of polyamine derivatives of fatty amines and/or salts of such amines and 99 to 60% by weight and, more particularly, 95 to 85% by weight of water as diluent and, optionally, auxiliaries and additives, based on the formulation as a whole.

Auxiliaries and/or additives suitable for the purposes of the invention are, in particular, solubilizers, for example alcohols, polyalcohols, ethers or polyethers, more particularly isopropanol, butyl glycol, butyl diglycol or ethylene glycol ether. The quantity of solubilizers to be used is dependent in each case on the amine used and will be determined by the expert by trial and error. Additions of solubilizer of 5 to 20% by weight, based on the formulation as a whole, are generally sufficient.

Other auxiliaries and/or additives suitable for the purposes of the invention are, in particular, nonionic and/or amphoteric surfactants, for example alkoxylated fatty amines, fatty alcohols and alkoxylated fatty alcohols. These surfactants are capable of improving the wetting of the chains and plate-type conveyor belts should this be necessary in any particular case. Additions of surfactant of 1 to 5% by weight, based on the formulation as a whole, are generally sufficient for this purpose.

The lubricant concentrates according to the invention preferably have a pH value in the range from 4 to 11 and, more particularly, in the range from 5 to 8. If the pH of the lubricant concentrate is not already in this range, it may be adjusted to the required value by addition of an acid, preferably an acid containing the above-defined anion $X^-$, for example with acetic acid or formic acid.

In the interests of optimal dosing, it is also of advantage for the lubricant concentrates to have a dynamic viscosity of less than 300 mPa.s, preferably less than 150 mPa.s and, more preferably, in the range from 20 to 100 mPa.s, as measured at 20° C., in order to guarantee their pumpability. Separate adjustment of the viscosity to the values mentioned is generally not necessary or, where it is necessary, may be carried out by addition of suitable quantities of the diluent water or a solubilizer.

The present invention also relates to a process for the production of the lubricants according to the invention. They may be produced by mixing of the amine components, optionally with addition of water and the auxiliaries and additives mentioned.

The present invention also relates to the use of lubricant concentrates of the type described above as chain lubricants in the food industry, more particularly in automatic chain and belt lubrication systems. More particularly, the invention relates to the use of the lubricant concentrates defined above in the form of a 0.01 to 50% by weight and preferably 0.1 to 0.5% by weight aqueous solution as chain lubricants for automatic chain and belt lubrication systems.

The present invention also relates to an aqueous lubricant solution based on fatty amines and, optionally, typical diluents, characterized in that it contains at least one polyamine derivative of a fatty amine and/or a salt of such an amine.

According to the invention, this lubricant solution may be prepared from the lubricant concentrates according to the invention by dilution with water by a factor of 2 to 10,000 and preferably by a factor of 300 to 500.

Lubricant solutions containing 0.002 to 0.1% by weight and, more particularly, 0.003 to 0.05% by weight of a polyamine derivative of a fatty amine corresponding to formula (I) for a pH value of 5 to 8 are particularly preferred.

Finally, the present invention relates to the use of the aqueous lubricant solutions described above as chain lubricants in the food industry. In contrast to standard soap products, the products according to the invention do not cause any stress cracking in plastic containers and, accordingly, may readily be used in particular for PET (polyethylene terephthalate) containers or PVC (polyvinyl chloride) containers. Accordingly, the lubricant solutions according to the invention may be used as chain lubricants for the transport of containers or bottles of glass, plastic-coated glass, plastics, more particularly polyethylene terephthalate or polyvinyl chloride, tin or aluminium or lacquered or plastic-coated containers of these metals on conveyor systems.

By comparison with known lubricants based on fatty amines, the products according to the invention show distinctly better clear water solubility and, in addition, have measured foaming behavior, favorable microbicidal properties and an excellent lubricating effect. The desired performance properties of the lubricant concentrate or the aqueous lubricant solution may be adjusted as required through the choice of the amine or the anion.

In addition, however, the lubricant concentrates and solutions according to the invention may also be used with advantage as so-called cutting oils or cooling lubricants in the machining of metals.

The invention is illustrated by the following Examples.

EXAMPLES

In the following Examples, all percentages are by weight.

Preparation of the aminoacetates (general procedure)

The performance properties of the polyamine derivatives of fatty amines corresponding to formula (I) were tested using their amino acetates. To prepare the acetates, 90 g of deionized water heated to 50 to 60° C. was initially introduced and 10 g of the particular amine was stirred in molten form into the water. The amino acetates were obtained by addition of acetic acid to a pH value of 6.5.

In the tests using clear solubility promoters, only 87 g as opposed to 90 g of water was initially introduced and, after pH adjustment, 3 g of the surfactant was stirred in.

Example I

Clear water solubility without addition of surfactants

To evaluate clear water solubility, a 0.2% by weight solution of the test mixtures in the test water was stored at 12° C., a water containing the following ingredients being used as the test water for the evaluation of clear water solubility (pH 7.5):

100 ppm sulfate ions 10 ppm phosphate ions 10 ppm silicate ions 100 ppm hydrogen carbonate ions 0.2% by weight solutions of the aminoacetate solution (amine content 0.02% by weight) were prepared with this water and were optically evaluated after 1 minute and 30 minutes.

The solubility behavior of the amines illustrated in Table I was observed in this way.

TABLE I

Amine $RR^aN(—(CH_2)_3—NH)_q—H$

| | R | $R^a$ | q | After 1 min. | After 30 mins. |
|---|---|---|---|---|---|
| 1 | Coco-alkyl | H | 2 | Clear solution | Clear solution |
| 2 | Tallow alkyl | H | 2 | Clear solution | Clear solution |
| 3 | Oil alkyl | H | 3 | Clear solution | Clear solution |
| 4 | Tallow alkyl | H | 3 | Clear solution | Clear solution |
| 5 | Coco-alkyl | H | 3 | Clear solution | Clear solution |
| 6* | Oil alkyl | H | 1 | Clear solution | Slightly opal solution |
| 7* | Tallow alkyl | $(CH_2)_3NH_2$ | 1 | Slightly opal solu-solution | Slightly opal opal solution |

*Comparison experiment

Example II

Clear water solubility with addition of surfactants

A water containing the following ingredients was used as the test water for the evaluation of clear water solubility with addition of surfactants (pH 7.32):

61.98 ppm sulfate 0.38 ppm phosphate 14.46 ppm silicate 45.44 ppm chloride 27.84 ppm nitrate 0.2% by weight solutions of the aminoacetate solution (amine content 0.02% by weight) were prepared with this water and were optically evaluated after 1 minute and after 30 minutes.

| Clear solubility promoter | After 1 min. | After 30 mins. | After 2 h | After 24 h |
|---|---|---|---|---|
| 1) Clear water solubility of the amine of Example I: | | | | |
| $C_{12-18}$ Fatty alcohol containing 2 ethylene oxide units (EO) | Clear solution | Clear solution | Clear solution | Clear solution |
| $C_{12-14}$ Fatty alcohol containing 4 EO opal | Clear solution | Clear solution | Clear solution | Slightly solution |
| 2) Clear water solubility of a mixture of equal parts of amines 6 and 7 of Example I (Comparison experiment): | | | | |
| $C_{12-18}$ fatty alcohol containing 2 EO | Clear solution | Slightly opal | Slightly opal | Opal |
| $C_{12-14}$ fatty alcohol containing 4 EO | Clear solution | Slightly opal | Slightly opal | Opal |

Example III

Lubricating effect

The aminoacetates described in Example I were tested for their lubricating effect. With the belt switched on, the friction coefficient μ (μ= holding force for the bottles/weight of the bottles), after-lubrication behavior (the time it takes the friction coefficient to increase by 50% without application of chain lubrication solution was measured) and foaming behavior were evaluated. The total amine content of these solutions is 0.01% by weight.

The lubricating effect of the amines is shown in Table II.

TABLE II

| Example | Amine base | Friction coefficient | After-lubrication | Foam |
|---|---|---|---|---|
| 1 | Amine 1* | $\mu < 0.1$ | 7.5 mins. | Thin foam film |
| 2 | Amine 2* | $\mu < 0.1$ | 8.5 mins. | Thin foam film |
| 3 | Comp. Experiment** | $\mu < 0.1$ | 7.5 mins. | No foam |

*Without surfactant

**Mixture of amine 6, amine 7, ester of dimer fatty acid ($C_{36}$) with polyethylene glycol (18 EO) and cocoamine containing 12 EO (10:10:5:2).

We claim:

1. A lubricant concentrate comprising from about 1 to about 40% by weight of at least one polyamine compound of formula (I):

$$R—A—(CH_2)_k—NH—((CH_2)_l—NH)_y—(CH_2)_m—NH_2.(H^+X^-)_n \quad (I)$$

in which

R is a substituted or unsubstituted, linear or branched, saturated or mono- or polyunsaturated $C_{6-22}$ alkyl radical, the substituents being selected from amino, imino, hydroxy, halogen and carboxy, or a substituted or unsubstituted phenyl radical, the substituents being selected from amino, imino, hydroxy, halogen, carboxy and linear or branched, saturated or mono- or polyunsaturated $C_{6-22}$ alkyl radical, A is either—NH— or —O—, $X^-$ is an anion of an inorganic or organic acid, k, l and m independently of one another are integers of 1 to 6, y is 0, 1, 2 or 3 where A=—NH— and 1, 2, 3 or 4 where A=—O— and n is an integer of 0 to 6.

2. The lubricant concentrate of claim 1 which also comprises from about 60 to about 99% by weight of water and/or other auxiliaries and additives.

3. The lubricant concentrate of claim 1 wherein in formula I the anion $X^-$ is selected from the group consisting of amidosulfonate, nitrate, halide, hydrogen sulfate, sulfate, hydrogen carbonate, carbonate, phosphate or $R^1$—$COO^-$, where $R^1$ is hydrogen or a substituted or unsubstituted, linear or branched $C_{1-20}$ alkyl radical or $C_{2-20}$ alkenyl radical, the substituents being selected from one or more of the radicals hydroxy, amino, imino and carboxy.

4. The lubricant concentrate of claim 1 wherein in formula I A=—NH—, k, l and m independently of one another have values of 3 or 4, and y=0 or 1.

5. The lubricant concentrate of claim 4 wherein in formula I k, l and m all have a value of 3.

6. The lubricant concentrate of claim 1 wherein in formula I

R is a linear or branched, saturated or mono- or polyunsaturated $C_{12-18}$ alkyl radical, A represents —NH—, and $X^{31}$ represents a group of the formula $R^1$—$COO^-$ where $R^1$ is hydrogen, $CH_3$—, HO—$CH_2$— or $CH_3$—CH(OH)—.

7. The lubricant concentrate of claim 1 wherein the at least one polyamine compound is present therein in from about 5 to about 15% by weight thereof.

8. The lubricant concentrate of claim 2 wherein the concentrate contains at least one of a solubilizer, a nonionic surfactant, and an amphoteric surfactant.

9. The lubricant concentrate of claim 1 wherein the concentrate has a pH in the range of from about 4 to about 11.

10. The lubricant concentrate of claim 9 wherein the pH is in the range of from about 5 to about 8.

11. In the lubrication of chains in the food industry the improvement wherein the lubricant concentrate of claim 1 is used as the chain lubricant.

12. The lubrication of chains in accordance with claim 11 wherein the chain lubricant of claim 1 is used in automatic chain and belt lubrication systems.

13. An aqueous lubricant solution which is the water-diluted lubricant concentrate of claim 1.

14. An aqueous lubricant solution which is the water-diluted lubricant concentrate of claim 8.

15. The aqueous lubricant solution of claim 13 wherein the lubricant concentrate is diluted with water by a factor of from about 2 to about 10,000.

16. The aqueous lubricant solution of claim 15 wherein said factor is from about 300 to about 500.

17. The aqueous lubricant solution of claim 13 which contains from about 0.002 to about 0.1% by weight of the at least one polyamine compound of formula I.

18. The aqueous lubricant solution of claim 17 which contains from about 0.003 to about 0.05% by weight of the at least one polyamine compound of formula I and the solution has a pH in the range of from about 5 to about 8.

19. In the food industry wherein conveyors are used to transport containers, the improvement wherein the aqueous lubricant solution of claim 13 is used as a chain lubricant for transporting containers or bottles of glass, plastic-coated glass, plastics, tin or aluminum, or lacquered or plastic-coated containers of these metals.

* * * * *